US007527714B2

(12) United States Patent
Kahite et al.

(10) Patent No.: US 7,527,714 B2
(45) Date of Patent: May 5, 2009

(54) WATER HEATER ANODE AND MOUNTING FIXTURE

(75) Inventors: Mutubwa K. Kahite, Madison, WI (US); Michael B. Steinhafel, Madison, WI (US)

(73) Assignee: Bock Water Heaters, Inc., Madison, WI (US)

( * ) Notice: Subject to any disclaimer, the term of this patent is extended or adjusted under 35 U.S.C. 154(b) by 255 days.

(21) Appl. No.: 11/673,859

(22) Filed: Feb. 12, 2007

(65) Prior Publication Data

US 2008/0190919 A1 Aug. 14, 2008

(51) Int. Cl.
*C23F 13/16* (2006.01)

(52) U.S. Cl. ..... 204/196.18; 204/196.17; 204/196.23; 204/196.24; 204/196.25; 204/196.3; 204/196.31; 204/196.37

(58) Field of Classification Search ..... 204/196.17, 204/196.18, 196.23–196.25, 196.3, 196.31, 204/196.37
See application file for complete search history.

(56) References Cited

U.S. PATENT DOCUMENTS

| | | | | |
|---|---|---|---|---|
| 0,999,108 | A | 7/1911 | Hickey | |
| 2,343,440 | A | 3/1944 | Andrus | |
| 2,459,123 | A | 1/1949 | Bates et al. | |
| 2,486,871 | A | 11/1949 | Osterheld | |
| 2,508,171 | A | 5/1950 | Kaufman | |
| 2,568,594 | A | 9/1951 | Robinson | |
| 2,805,987 | A * | 9/1957 | Thorn, Jr. et al. | 204/196.19 |
| 3,012,958 | A | 12/1961 | Vixler | |
| 3,414,707 | A | 12/1968 | Aldous | |
| 3,660,264 | A | 5/1972 | Schuller | |
| 3,742,588 | A * | 7/1973 | George | 29/458 |
| 4,035,903 | A * | 7/1977 | Taggart | 29/458 |
| 4,060,472 | A * | 11/1977 | Alewitz | 204/196.16 |
| 4,093,529 | A * | 6/1978 | Strobach | 204/196.11 |
| 4,407,711 | A | 10/1983 | Baboian et al. | |
| 4,786,383 | A * | 11/1988 | Houle | 205/731 |
| 4,830,724 | A | 5/1989 | Houle | |
| 4,954,172 | A * | 9/1990 | Houle et al. | 204/196.16 |
| 4,954,233 | A | 9/1990 | Houle et al. | |
| 5,256,267 | A * | 10/1993 | Roden | 204/196.11 |
| 5,728,275 | A * | 3/1998 | Twigg | 204/196.23 |
| 7,017,251 | B1 * | 3/2006 | Murphy | 29/458 |
| 2007/0125640 | A1 * | 6/2007 | Marcelino et al. | 204/196.01 |

* cited by examiner

*Primary Examiner*—Bruce F Bell
(74) *Attorney, Agent, or Firm*—Stiennon & Stiennon

(57) ABSTRACT

An anode is mounted to the top of a water heater tank which has a spud with external threads welded to the top thereof. The spud extends above insulation which surrounds the water tank and covers the top of the water heater. An anode rod is inserted into the water tank through the spud and has a steel core welded to a flat cylindrical steel disk which extends radially outwardly of a magnesium cylinder formed about the core. A water sealing gasket is positioned between the disk and the annular surface formed by the open end of the spud. A nut fits over the disk and engages the threads on the spud, and clamps the anode to the spud so that the threads are isolated from water in the tank, allowing easy removal of the anode after the passage of time.

19 Claims, 2 Drawing Sheets

WATER HEATER ANODE AND MOUNTING FIXTURE

CROSS REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates generally to water heaters and water tanks and more particularly to the sacrificial anode in a water tank.

Water heaters have a variety of applications. A common use is for the heating of water in a residential structure. A water heater has a water tank, typically manufactured of steel. The water tank is typically cylindrical to withstand pressure and for simplicity of manufacture. The tank is oriented with the axis of the cylinder vertical so that a firebox may be positioned beneath the water tank and an exhaust stack may extend along the cylindrical axis through the water tank. To decrease heating costs, the water tank is often insulated.

To protect a steel water heater tank from corrosion, the interior of the tank is coated with a glass lining formed by coating the tank interior with an enamel and heating the tank to form the glass lining. However, small voids or cracks may be present as manufactured or may form later in the glass coating, possibly exposing the metal tank walls to corrosion. To protect against corrosion a sacrificial metal anode rod attached to a threaded fitting is screwed into a threaded boss at the top of the tank.

Cathodic corrosion is an electro-chemical phenomenon in which a metal tends to return to its native oxide state. This corrosion can be slowed, and even stopped, by making the surface to be protected the cathode of an electrochemical cell. Thus, an anode must be supplied that has a more negative electrochemical potential than the potential of the steel surface to be protected. Anodes are typically made of alloys of zinc, magnesium, and aluminum to protect steel surfaces.

Because of the sacrificial nature of the anode, it is necessary to replace the anode periodically as it is depleted. However, access to the anode mounting is hampered when the fitting is buried in insulation which covers the top of the tank. Moreover, if threads on the anode and the tank are not isolated from the water in the tank, the threads could become corroded, making the removal of the anode difficult. What is needed is a sacrificial anode which mounts with good electrical contact to the tank yet which is readily and expeditiously replaceable.

SUMMARY OF THE INVENTION

The invention is an anode and an arrangement for mounting the anode to the top of a water heater water tank. The water heater tank has a short vertical pipe or spud welded at one end to the top of the tank and forming an opening at the other end. The spud extends vertically from the top of the water tank, and gives access to the interior volume of the water tank through the open end. The spud extends above insulation which surrounds the water tank and covers the top of the water heater. The spud has external threads on the portion of the spud that protrudes beyond the tank insulation. An anode rod is inserted into the water tank through the spud. The anode rod is constructed of a magnesium cylinder and has a steel core that extends along the axis of the magnesium cylinder. The steel core extends through and is welded to a flat cylindrical steel disk terminating one end of the anode rod. The weld electrically connects the flat steel disk to the anode rod. The magnesium cylinder surrounding the steel core extends below the flat steel disk for the entire length of the anode rod. The flat steel disk extends radially outwardly of the magnesium cylinder giving the anode rod a T-shaped vertical cross-section. The flat steel disk has an annular, i.e. circumferential, or ringlike, surface that surrounds and faces the magnesium cylinder and is without threads.

When the anode rod is installed in the spud the annular surface faces a corresponding annular surface formed by the open end of the spud. A water sealing gasket is positioned between the flat steel disk and the annular surface formed by the open end of the spud. The gasket is made of an elastomer in the shape of a ring or washer. The gasket is held in sealing contact between the annulus of the flat steel disk and the flat end face of the spud threaded end by a hexagonal nut with internal threads which fits over the steel disk of the anode, the internal threads of the nut engage the external threads on the spud. By tightening the nut the gasket is clamped between the annular surface formed by the open end of the spud and the annular surface face of the disk at the top of the anode. The nut has a recess in the center or has a central hole to receive a bump on the anode disk where the steel core is welded to the disk. Electrical continuity is provided between the magnesium of the anode and the water heater tank by way of the steel core, to the disk, to the nut, to the spud which is welded to the water tank.

It is an object of the present invention to provide a water heater with longer service life.

It is another object of the present invention to provide a water heater anode mounting arrangement that is easier to service and maintain.

It is a further object of the present invention to provide a water heater anode that is more easily accessed and replaced.

It is another object of the present invention to provide a water heater anode where the anode mounting arrangement has a reduced tendency to corrode.

Further objects, features and advantages of the invention will be apparent from the following detailed description when taken in conjunction with the accompanying drawings.

DESCRIPTION OF THE PREFERRED EMBODIMENTS

Figure 3:
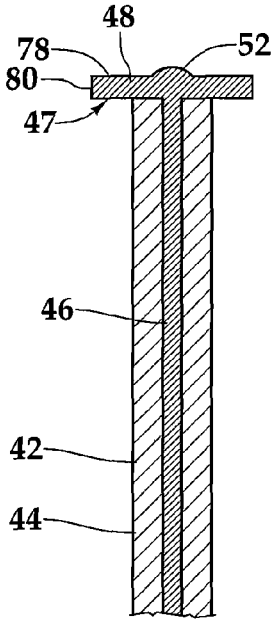
FIG. 3 is a side elevational cross-sectional view of the anode of the device of FIG. 2.
Figure 4:
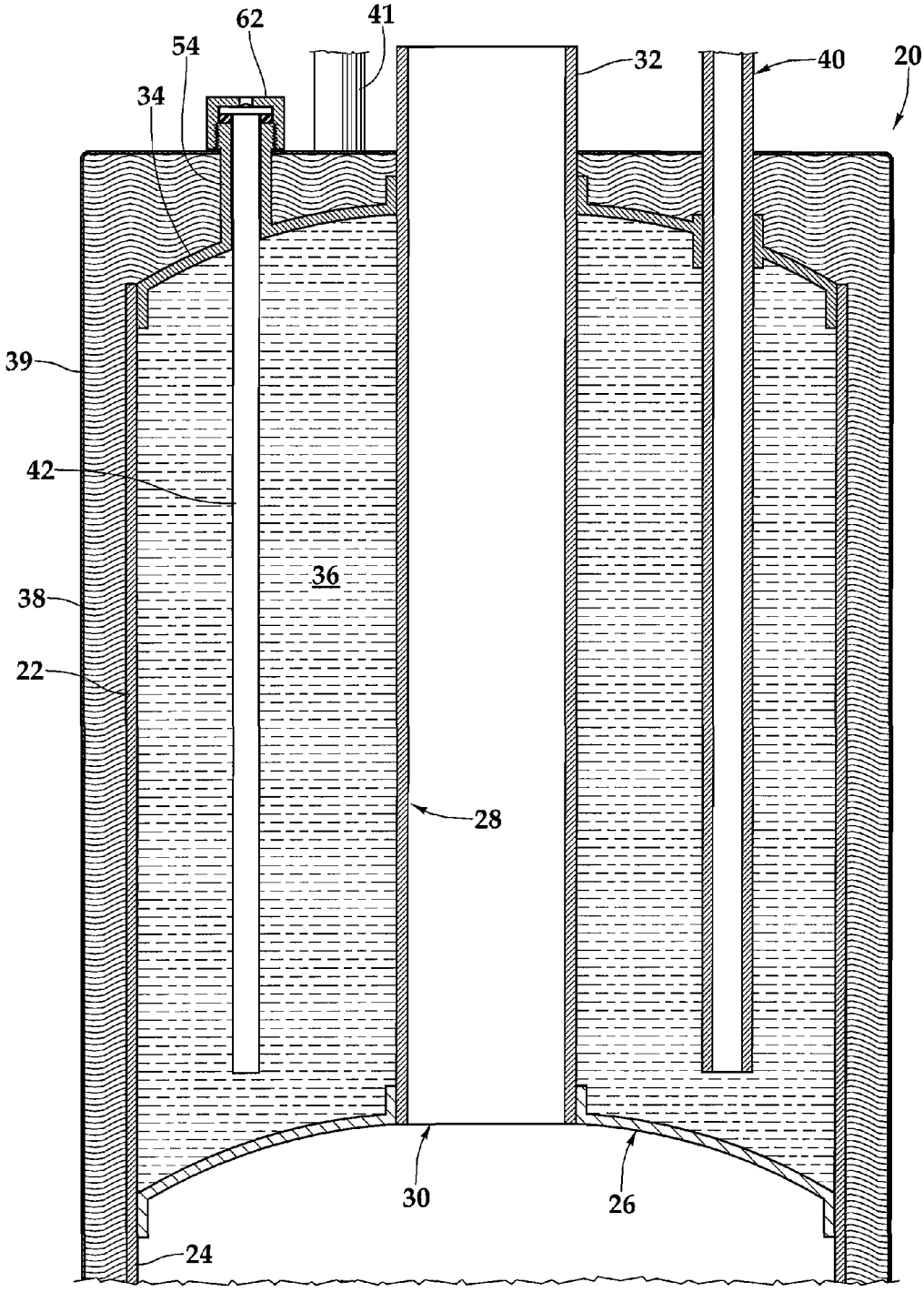
FIG. 4 is an side elevational cross-sectional view of the water heater tank and anode mounting arrangement of this invention.

Referring more particularly to FIGS. 1-4, wherein like numbers refer to similar parts, a water heater 20 is shown in FIG. 4. The water heater 20 has a water tank 22 which is separated from a combustion chamber 24 by a bottom dome 26. A central steel flue 28 extends between an opening 30 in the bottom dome 26 and a top dome 34 of the water heater tank 22. A burner, not shown, is positioned below the water tank 22. The burner may operate on oil, natural gas, propane or other fuel. The exhaust gases from the burner flow upwardly through the central flue 28 to the flue outlet 32, exchanging heat with the water 36 contained within the water tank 22. Heat is also exchanged between the dome 26, and the water 36 contained in the water tank 22. Portions of water tank 22 are covered by a layer of insulation 38 that helps to prevent heat losses to the surrounding air. The insulation 38 is in turn surrounded by a sheet metal cover 39. The thickness of the insulation 38 depending upon the type of material the insulation 38 is made of and is generally in the range of 0.5 inch to 2 inches.

The water tank 22 has a cold water inlet 40, on the top dome 34 where cold water is introduced through a pipe that extends to near the bottom of the water tank 22. A hot water outlet 41 is also located on the top dome 34. The hot water outlet 41 extends into the water 36 near the top of the water tank 22. As hot water leaves through the outlet 41 of the water tank 22, cold replacement water enters through the cold water inlet 40 into the bottom of the water tank 22.

Because water 36 is an ionic compound, it promotes the oxidation of materials in contact with it. Ferrous materials, such as steel, are especially prone to cathodic corrosion because of this oxidation. Common practice is to coat all surfaces coming in contact with water, including the steel water tank 22, the bottom dome 26, the top dome 34, and the outside surface of the flue 28, with an enamel material to prevent this corrosion from taking place. The enamel is painted or coated onto the steel surface. The enamel coating is then fired to form a protective, glass-like lining on the steel surface. However, small defects may exist in the coating or small cracks may develop in the coating over time. These defects or cracks allow water 36 to come in contact with the steel surface of the water tank 22 thus promoting cathodic corrosion, and reducing the operational life of the water heater 20.

Cathodic corrosion is an electrochemical process that occurs when water 36 comes in contact with the steel water tank 22, causing the steel to oxidize. To protect the steel water tank 22 cathodic protection supplied by an anode 42 of sacrificial material is used. The anode 42 is formed of cast or extruded magnesium cylinder 44 surrounding a steel core 46 or wire as shown in FIG. 3. The magnesium cylinder 44 is more electronegative than steel and acts as a sacrificial material, corroding in place of the steel water tank 22. Electrons leave the magnesium cylinder 44 which is electrically part of the anode 42 and travel a grounded path to the steel water tank 22 which serves as a cathode. This will occur as long as there is good electrical conductivity between the anode 42, the water 36, and the water tank 22, and as long as the magnesium cylinder 44 remains attached to the steel core 46. As the magnesium of the cylinder 44 erodes from the anode 42, the steel core 46 prevents the magnesium from separating from the anode and maintains electrical contact with the wall of the tank 22. When no magnesium material remains on the anode 42, the anode 42 must be replaced to protect the steel water tank 22 from corrosion.

The construction of the anode 42 is shown in FIG. 3. A cylinder of magnesium 44 surrounds a steel core 46 and is topped by a flat steel disk 48. The length of the anode 42 is selected to ensure that the rod extends from the top of the water tank 22 to nearly the bottom of the water tank 22, typically a distance of three to four feet, e.g. 42 inches. The steel core 46 extends through the flat steel disk 48 and is welded to the disk forming a weldment which has a steel nub 52 in the center of the flat steel disk 48. The weld between the steel core 46 in the disk 48 forms a mechanical and electrical connection between the core and the disk. Once the flat steel disk 48 is attached, the anode rod 42 has a T-shaped cross-section. The bottom side 47 of the flat steel disk 48 forms an annulus around the magnesium cylinder 44 that serves as a sealing surface. The top side of the flat steel disk 48 is engaged by and compressed by a corresponding annular surface 61 of a nut 62, shown in FIG. 1.

Figure 1:
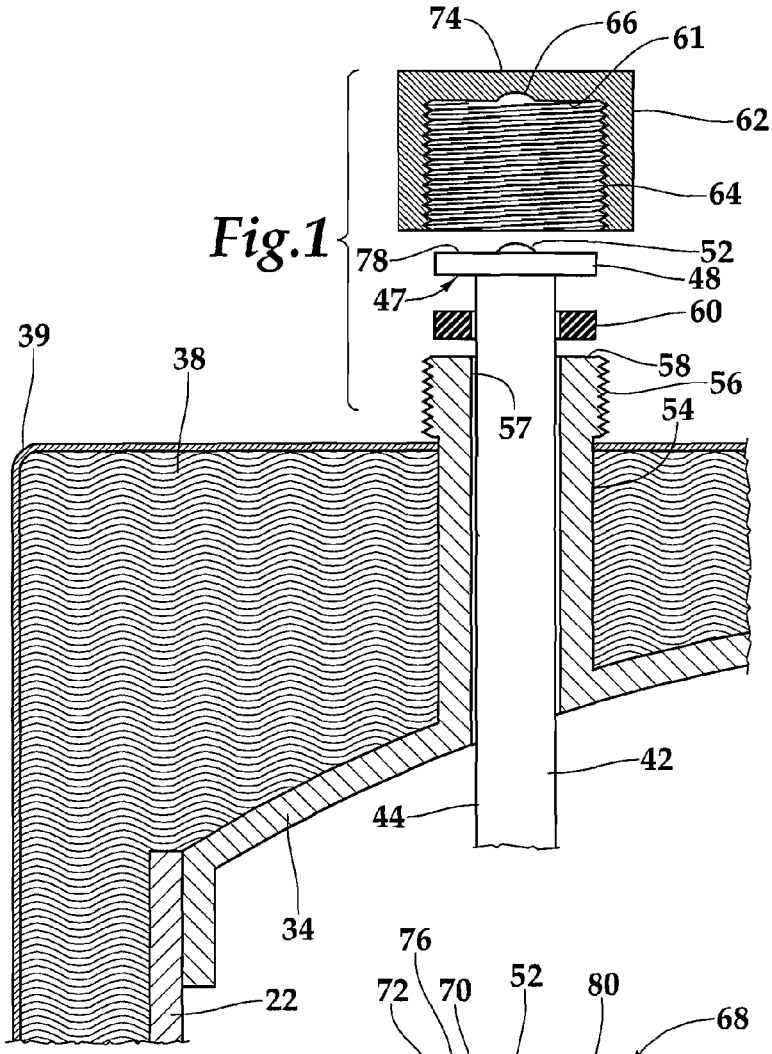
FIG. 1 is a side elevational cross-sectional partially exploded view of the water heater anode mounting arrangement interface with a water tank of this invention.

The anode mounting arrangement is shown in FIG. 1. The anode rod 42 is fitted to a short spud 54 that has a first end that is preferably welded to the top 34 of the water tank 22. The spud 54 has external threads 56 on the open end 57 of the spud. The length of the spud 54 is selected to be greater than the thickness of the insulation 38 which covers the top dome 34 of the water tank 22 and so that the external threads 56 are clear of the insulation 38. The spud 54 has an internal diameter selected to be greater than the diameter of the anode 42. The diameter of the anode 42 is typically ¾ or one inches. The spud 54 has a second end that terminates in an end face 58 which forms a flat water sealing surface. The anode 42 is passed through the spud 54 and extends into the water tank 22 making contact with the water 36. A gasket 60 in the form of an elastomeric washer, or other sealing material, is placed between the bottom sealing surface 47 of the flat steel disk 48 and the end face 58 of the spud 54. The gasket 60 is preferably made of an elastomer or rubber material to facilitate water tight sealing and to conform to the sealing surfaces of the spud 54 end face 58 and the flat steel disk 48.

The anode 42 is clamped against the end face 58 of the spud 54 by a hexagonal nut 62 that covers the flat steel disk 48. Internal threading 64 of the nut 62 engages the external threading 56 of the spud 54, as shown in FIG. 1. The gasket 60 prevents water from reaching the engaged threads 56, 64, which prevents corrosion which would make removal and replacement of the anode difficult. The nut 62 has a downwardly opening central recess 66 to receive the welding nub 52 on the anode 42. The nut 62 compresses the flat steel disk 48 against the gasket 60 and provides electrical continuity between the anode 42 and the water heater tank 22. The nut 62 is a cap nut, or acorn nut, having a cap 74 on the interior of which the annular surface 61 which engages the steel disk 48 is formed.

The anode 42 gradually dissolves over time to protect the water tank 22 and should be replaced periodically, for example yearly. The arrangement illustrated in FIG. 1 overcomes the prior art difficulties of gaining access to the anode and of corrosion of the threads which attach the anode to the water tank. The threads 56 on the spud 54 which are engaged with the threads 64 of the nut 62 are isolated from the water contained within the water tank by the gasket 60 so threads do not become corroded, allowing the nut to be readily loosened and removed. Once the nut 62 is removed, the anode is no longer attached to the water heater but simply rests on the gasket 60 by means of the steel disk 48 and thus may be easily removed from the water tank. A new anode 42 together with the new gasket 60 is installed and the nut 62 is replaced and tightened, compressing the steel disk of the new anode against the gasket.

Figure 2:
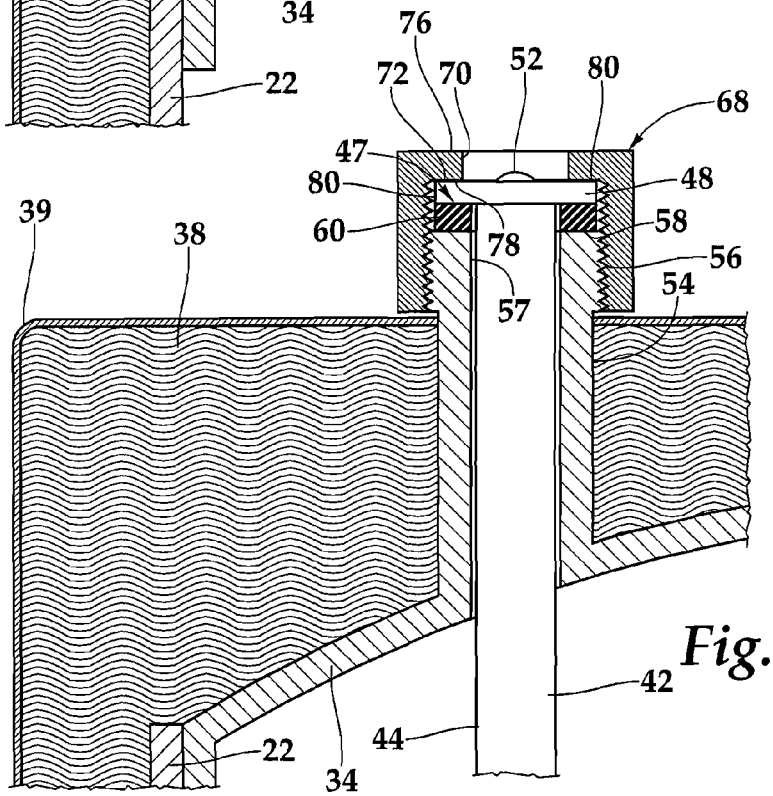
FIG. 2 is a side elevational cross-section plan view of the assembled water heater anode mounting arrangement of FIG. 1.

An alternative nut 68 is shown in FIG. 2. The nut 68 has portions forming an opening 70 centered over the anode rod 42. The nut 68 has a partial cap 76 which has an annular surface 72 which surrounds the opening 70 and which engages portions 78 of the steel disk 48 near its periphery 80. A portion of the disc 48 compresses the gasket 60 between the sealing surface 47 of the disk 48 and a sealing end face surface 58 of the spud 54. The open nut design prevents the nut from engaging the nub 52.

It should be understood that the magnesium cylinder 44 could be any sacrificial metal used to protect steel, such as zinc or aluminum. It should further be understood that the cylinder of sacrificial metal may be flexible, or formed as discontinuous pieces attached to the core so that the anode rod can be bent to facilitate insertion into a water heater mounted beneath a low ceiling. It should be understood that although the disk 48 and the core 46 are described as constructed of steel it should be understood that steel as used in the claims includes pure iron, alloys of iron with carbon, and alloys of iron with other alloy materials. It should also be understood that the annular sealing surface 58 of the spud, and the sealing surface 47 on the steel disk 48 could have shapes other than the flat parallel surfaces illustrated in the figures, including any arrangement which functions to engage the gasket 60 to form a watertight seal.

It should be understood that wherein nuts 62, 68 are described and claimed as having portions that engage the steel disk 48 and bias the steel disk against the gasket 60 and the second end of the spud 54, a washer or other electrically conductive spacer placed between the nut and the spud is intended. It should also be understood that the water tank described and claimed is the water tank of a direct fired or indirect fired water heater or is a water storage tank.

It is understood that the invention is not limited to the particular construction and arrangement of parts herein illustrated and described, but embraces all such modified forms thereof as come within the scope of the following claims.

We claim:

1. A tank assembly for holding hot water, comprising:

a steel water tank, the water tank having a cylinder portion and a top dome; and an electrically conductive spud of a selected length, the spud having a first end which is attached to the top dome of the water tank and defining an opening into the water tank, wherein the spud extends upwardly from the water tank and terminates in a second end having portions defining external threads; and an anode rod of a selected length extending through the spud into the water tank, the anode rod having a first end and a second end, the anode rod having a steel core and a quantity of sacrificial metal surrounding the steel core; and a steel disk, the steel disk attached to the steel core and centered with respect to the steel core at the first end of the anode rod, the steel disk being electrically connected to the anode rod steel core; and a water sealing gasket which encircling the anode rod, the gasket fitting between the second end of the spud and the steel disk; and an internally threaded electrically conductive nut threadedly engaged with the external threads of the spud, the nut having portions that engage the steel disk and bias the steel disk against the gasket and the second end of the spud.

2. The tank assembly of claim 1 wherein the sacrificial metal is magnesium.

3. The tank assembly of claim 1 wherein the spud and the top dome of the water tank form a weldment.

4. The tank assembly of claim 1 wherein the steel disk and the anode steel core form a weldment.

5. The tank assembly of claim 4 wherein the weldment steel disk has a protruding steel nub, and wherein the nut has a cap which extends over the steel disk, said cap having portions defining a recess which receives therein the steel nub.

6. The tank assembly of claim 4 wherein the welded steel disk has a periphery and a slightly protruding steel nub, and wherein the nut has a partial cap which extends over portions near the periphery of the steel disk, but wherein the partial cap does not extend over the steel nub.

7. A water tank anode, comprising:

a steel rod;

a steel disk welded to the steel rod to form a weldment having a T-shaped cross-section;

a cylinder of sacrificial metal attached to the steel rod, wherein the steel disk is without threads and extends radially outwardly of the steel rod to form an annular surface extending outwardly of the cylinder and facing the cylinder which defines a sealing surface.

8. The water tank anode of claim 7 further comprising a water sealing gasket which fits over the cylinder and abuts the steel disk annular surface.

9. The water tank anode of claim 7 wherein the sacrificial metal is magnesium.

10. The water tank anode of claim 7 wherein the cylinder is substantially straight and continuous.

11. A water tank replacement anode kit, comprising:

an anode comprised of: a steel rod, a steel disk welded to the a steel rod to form a weldment having a T-shaped cross-section, and a cylinder of sacrificial metal attached to the steel rod, wherein the steel disk is without threads and extends radially outwardly of the steel rod to form an annular surface extending outwardly of the cylinder and facing the cylinder which defines a sealing surface; and an elastomeric washer sized to pass over the cylinder of sacrificial metal and sized to abut the steel disk annular surface in sealing engagement therewith.

12. The kit of claim 11 wherein the sacrificial metal is magnesium.

13. The kit of claim 11 further comprising an internally threaded electrically conductive nut having portions sized to engage the steel disk to bias the steel disk against the elastomeric washer.

14. A tank assembly for holding hot water comprising:

a steel water tank, the water tank having a cylinder portion and a top dome;

insulation enclosing the water tank;

an electrically conductive spud of a selected length, the spud having a first end attached to the top dome of the water tank and defining an opening into the water tank, wherein the spud extends upwardly from the water tank to a second end, the spud second end having external threads and an annular upwardly facing sealing surface;

an anode extending through the spud into the water tank, the anode having a steel core and a quantity of sacrificial metal surrounding the steel core;

a steel disk, the steel disk connected to the steel core at a first end of the anode, the steel disk electrically connected to the anode steel core;

a water sealing gasket, the gasket surrounding the anode, the gasket fitting between the annular upwardly facing sealing surface of the spud and the steel disk; and an internally threaded electrically conductive nut threadedly engage with the external threads of the spud, the nut having portions that engage the steel disk and bias the steel disk against the gasket and the second end of the spud.

15. The tank assembly of claim 14 wherein the sacrificial metal is magnesium.

16. The tank assembly of claim 14 wherein the spud and the top dome of the steel water tank form a weldment.

17. The tank assembly of claim 14 wherein the steel disk and the anode steel core form a weldment.

18. The tank assembly of claim 17 wherein the steel disk of the weldment has a protruding steel nub, and wherein the nut has a cap which extends over the steel disk, said cap having portions defining a recess which receives therein the steel nub.

19. The tank assembly of claim 17 wherein the steel disk of the weldment has a periphery and a protruding steel nub, and wherein the nut has a partial cap which extends over portions near a periphery of the steel disk, but wherein the partial cap does not extend over the steel nub.

* * * * *